US008353142B2

(12) United States Patent
Ross

(10) Patent No.: US 8,353,142 B2
(45) Date of Patent: Jan. 15, 2013

(54) SYSTEM AND METHOD FOR SEALING SUMP COVERS

(76) Inventor: Timothy Ross, Madison, IN (US)

( * ) Notice: Subject to any disclaimer, the term of this patent is extended or adjusted under 35 U.S.C. 154(b) by 183 days.

(21) Appl. No.: 12/834,856

(22) Filed: Jul. 12, 2010

(65) Prior Publication Data

US 2010/0276424 A1 Nov. 4, 2010

(51) Int. Cl.
*E04B 1/00* (2006.01)

(52) U.S. Cl. ..... 52/745.15; 52/19; 52/169.6; 404/25; 277/634

(58) Field of Classification Search ..... 52/19, 20, 52/169.6, 171.1; 277/630, 634, 637; 404/25, 404/26

See application file for complete search history.

(56) References Cited

U.S. PATENT DOCUMENTS 3,154,821 A * 11/1964 Weker ..... 52/168
3,674,149 A * 7/1972 Donalson ..... 210/163
4,655,361 A 4/1987 Clover et al.
4,706,718 A * 11/1987 Milo ..... 141/86
4,717,036 A 1/1988 Dundas et al.
4,762,440 A 8/1988 Argandona
4,842,443 A 6/1989 Argandona
5,058,633 A 10/1991 Sharp
5,117,877 A * 6/1992 Sharp ..... 141/86
5,222,832 A 6/1993 Sunderhaus et al.
5,271,518 A * 12/1993 Webb ..... 220/320
5,595,456 A 1/1997 Berg et al.
6,266,928 B1 * 7/2001 Argandona ..... 52/20
6,527,476 B1 * 3/2003 Pettesch ..... 404/26
7,043,965 B2 5/2006 Schneider
7,171,994 B1 2/2007 O'Brien

* cited by examiner

*Primary Examiner* — William Gilbert
*Assistant Examiner* — Gisele Ford
(74) *Attorney, Agent, or Firm* — Roberts IP Law; John Roberts

(57) ABSTRACT

Disclosed is a system and method for sealing containment sumps used in connection with underground storage tanks. A sump cover sealing system includes an expansion ring assembly adapted to affix to the interior of the sump, and to fastenably attach with the sump cover to removably seal the sump cover to the sump. A contraction band assembly is also provided to affix to the exterior of the sump opposite the expansion ring assembly. Methods of using the system are described. A sump cover with an observation portal is provided.

20 Claims, 7 Drawing Sheets

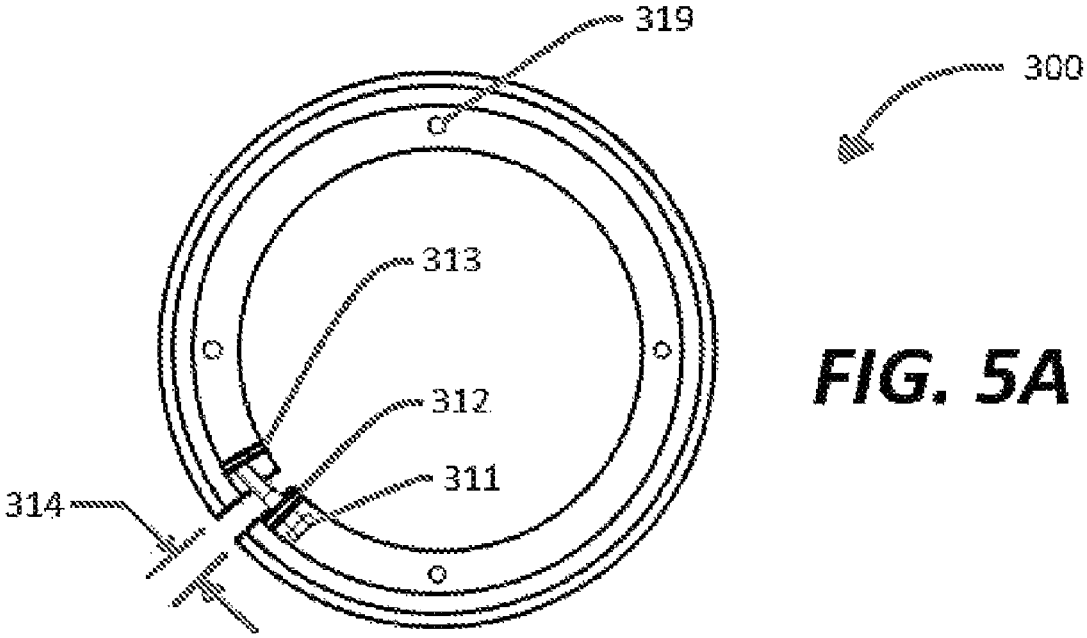
FIG. 5A
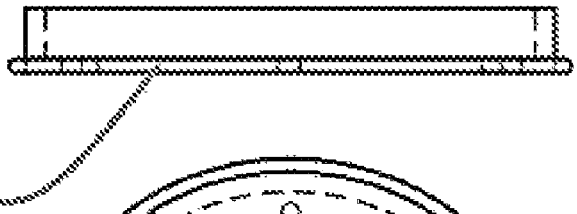
FIG. 5B
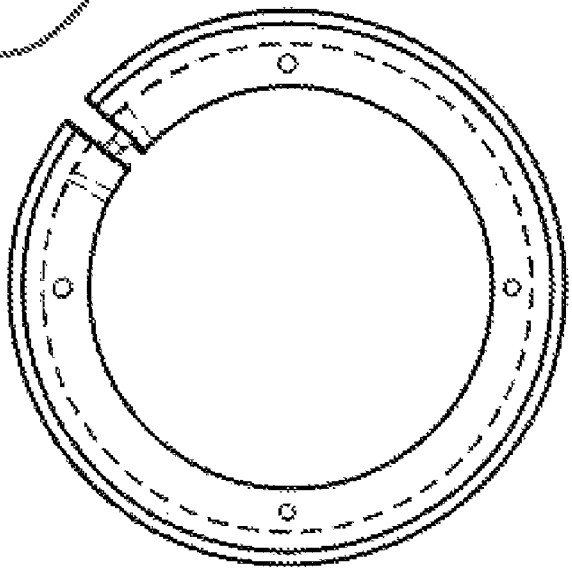
FIG. 5C
FIG. 5

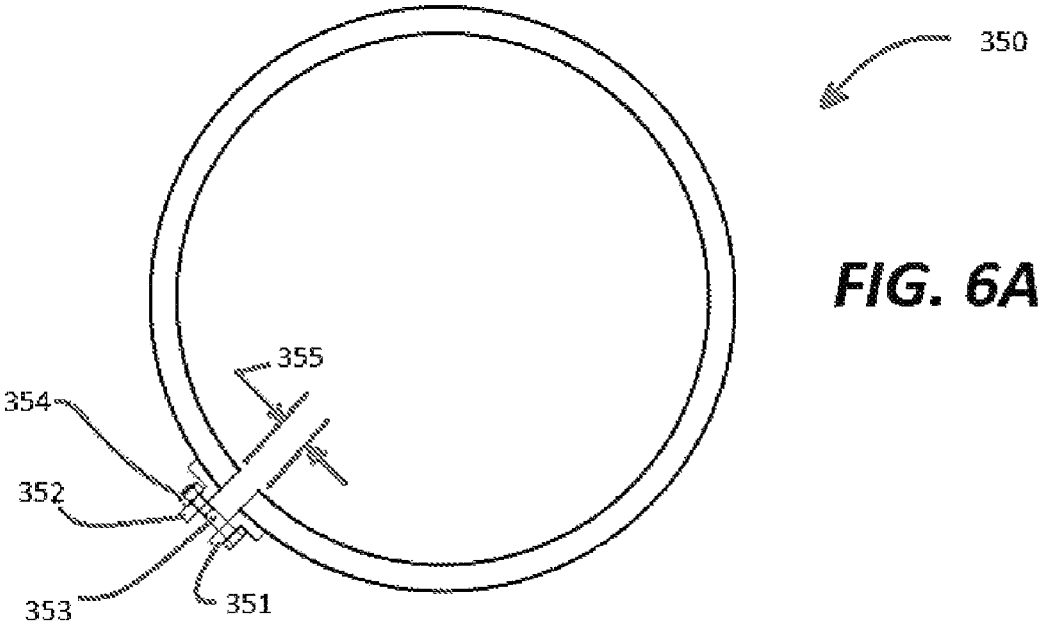
FIG. 6A
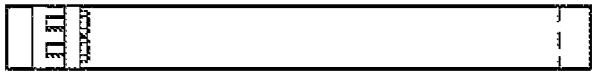
FIG. 6B
FIG. 6

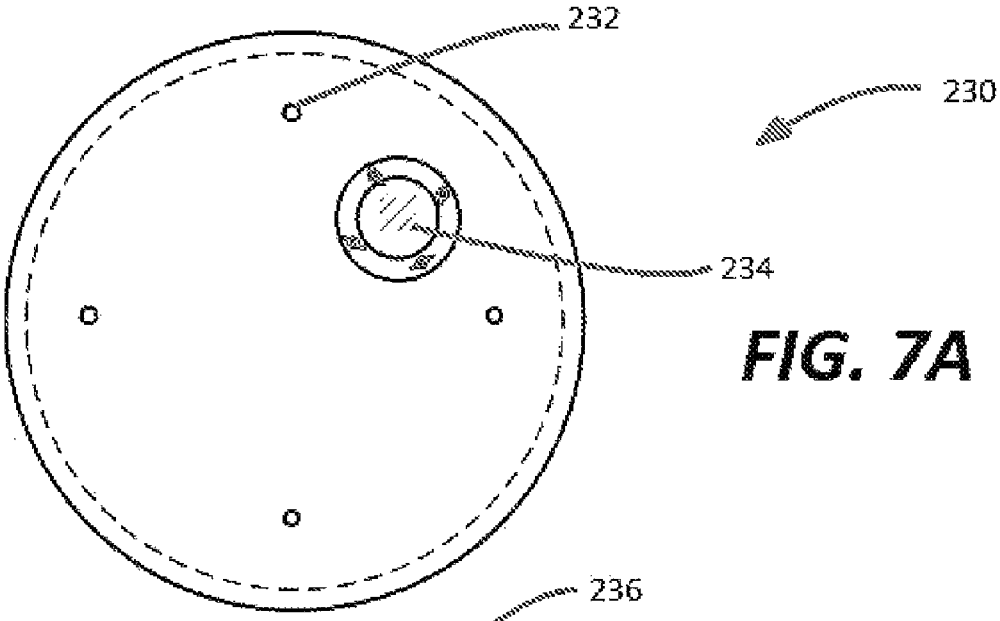
FIG. 7A
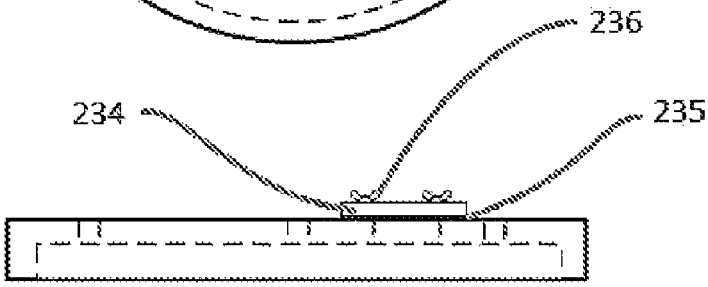
FIG. 7B
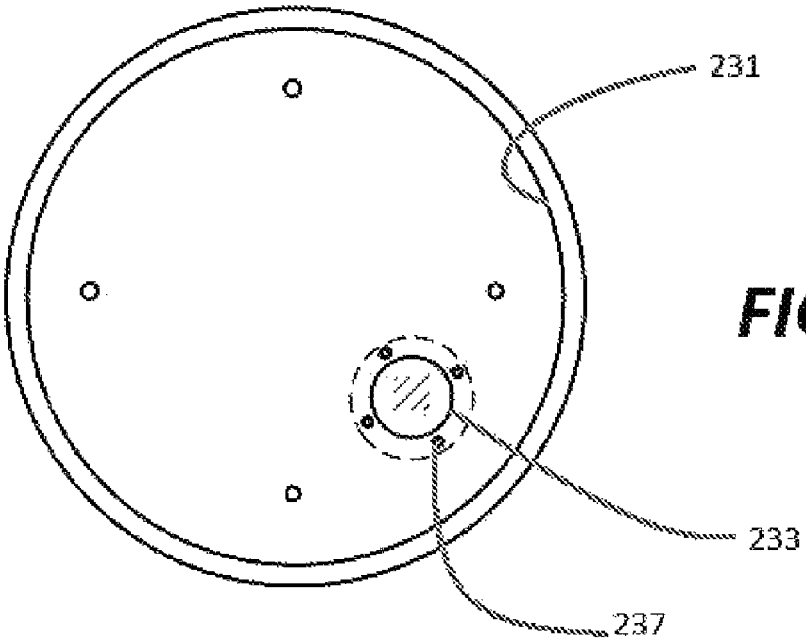
FIG. 7C
FIG. 7

SYSTEM AND METHOD FOR SEALING SUMP COVERS

BACKGROUND

1. Field of the Invention

The invention relates to a system and method for sealing containment sumps and the like, and is suitable for use with underground storage tanks.

2. Discussion of the Background

Underground storage tanks ("UST") are used in a wide variety of locations to store materials underground. The stored materials are often harmful to the environment. Examples of such materials include gasoline and other petroleum products, e.g., oil and waste oil, as well as toxic raw materials and waste from manufacturing processes. Because of the harmful nature of these materials, it is especially important to ensure that underground storage tanks containing such materials do not leak or release these materials into the environment.

The use of underground storage tanks for the containment of petroleum fuels and the like is particularly well known. A typical gasoline service station installation comprises one or more underground storage tanks which can be accessed through a removable plate in the apron of the facility, to fill and remove gasoline. Typically, an underground storage tank is also provided with a manway or manhole, if large enough to require access to the interior, through which manway a variety of fixtures, such as a filling device, a submersible pump, and other fixtures as required, are provided. While the fixtures generally penetrate through the manway lid, the manway itself may be provided with a removable lid to access the interior of the tank. While other types of underground storage tanks abound and are within the scope of the present invention, such as cryogenic tanks and the like, the dominant form of underground storage tank is for the storage of petroleum fuels such as gasoline, diesel fuel and the like.

The initial use of underground storage tanks included the preparation of steel tanks, or tanks of various other metal alloys. Steel, being relatively light weight and sufficiently strong to withstand applied pressures, provide sure resistance and the like, provided a building material which could be easily worked with. Examples of such tanks abound in the literature, and steel tanks are made today for such purposes. However, steel and other metal alloys are subject to rust and corrosion. Even in a "dry hole," that is an installation provided in the ground which does, not fill with water, rain water, ground water and additional sources of moisture such as runoff and the like, will accumulate and the tank is exposed, both from the inside and the outside, to potential corrosion sources. In the worst case, the hole in which the tank is installed may fill, either due to altered surface circumstances like flooding, leading to an accumulation of water in the hole, or commonly, due to a high water table. Under these circumstances, highly corrosive brine may be present also in the hole, as is commonly encountered in coastal sites. Corrosion of the tanks can lead to spot holing, as well as weakened strength, buckling and the like. Whether due to holing or a structural collapse, escape of the contained materials from the confines of the tank due to a failure pose severe environmental hazards. Cleanup of released fuel from a failed tank poses severe time and monetary considerations.

To overcome the tendency of steel to rust and corrode, reinforced plastic tanks have been adopted. Specifically, fiberglass reinforced resin tanks have been used, fiberglass tanks being resistant to corrosion and rusting. The resinous material used as the matrix is selected from a variety of materials, specifically desired to be resistant to penetration by, or adsorption of, the fuels or liquids to be contained, including methanol, ethanol as well as more familiar fuels such as gasoline and the like. A wide variety of resins may be employed in a single tank, including a highly specialized coating (such as a vinyl ester resin) to ensure that the contained material cannot pass into the body of the tank, which may be of a more conventional resin. The fiberglass tanks may be molded off of male forms or female forms.

Persistent concerns over potential environmental hazards have lead to the adoption of "double-walled tanks," in which the tank containing the fluid material is provided with a surrounding wall, or second wall, such that in the event the interior wall fails, the exterior wall will contain the fluid and avoid release to the environment until repairs can be effected. In the annulus between the inner and outer walls alarm devices of a variety of designs are provided, so as to detect the passage of liquid from the interior tank, or through the exterior tank, into the annulus. In a "dry annulus," detection of the presence of liquid due to changes in sensed electrical conditions are frequently used. A "filled" annulus tank may use an alarm device which senses a change in the fluid level of the annulus, which will occur upon failure of either the inner or the outer tank. In another alternative, the annulus may be slightly pressurized either positively or negatively, such that a leak causes a drop in pressure which may be detected.

In conjunction with such double-walled tanks, it may be customary to provide double-walled piping from the pump, filling means and the like, or in the case of a single network, piping in and between various tanks. In such a system, the contained liquid is dually contained throughout the system.

In order to access the tank to fill it, to pump fluid out of the tank, to repair the tank and the like, a manway is generally provided into the tank. A releasable cover provided over the manway contains fittings which pass through, and thereby provide a means to pass liquid into and out of the tank. If the tank needs service, and is of a suitable dimension to accommodate a worker, the cover of the manway itself can be removed, to provide access to the interior.

Tanks are generally buried to a standard depth underground. Principal manufacturers of underground storage tanks may provide precise instructions as to the depth, size and character of the hole or opening in which the tank will be set. To access the manway from the surface or apron of the installation, it is necessary to have a clear space or column from the manway to the surface. This is typically provided through a tubular means rising from the surface of the underground storage tank to a point just below the access provided in the ground level of the facility. This device is called a riser.

Frequently, piping accessing the manway will go through the riser to the manway. In order to fill the tank, the manway is accessed by opening the cover in the ground level, accessing the manway through the riser, and providing the necessary liquid material. To ensure dual containment of the fluid wherever it passes, the manway itself may be duly contained by the riser. Where the riser is intended as the secondary containment, or sump, an alarm means is frequently provided in the riser, to detect the accumulation of liquid therein. For the reasons discussed above, such a containment riser (hereafter referred to as a containment sump, or sump) is generally constructed of fiberglass reinforced plastic material, and adhered to the outer wall of the tank, if double walled, by application of resinous material thereto. The sump may be put in place in situ, or provided on the tank.

Recent, repeated severe flooding of many parts of the country has resulted in numerous underground storage tanks where the water level has risen over the top of the sump (indeed, above preexisting ground level) for an extended period of time. Further, the water table in many parts of the country may rise for extended periods to a height exceeding all or part of the riser. Under these circumstances, where there is a sump cover (which must be removable to provide access), the sump cover may be lifted by the water and accumulated liquids pour into the sump, frustrating alarm systems, impeding access to the manway, and providing a potential threat to the integrity of dual containment in a double-walled system.

Also, after a period of time, a build-up of debris/silt may form a dam between the skirt material of the manway and the containment sump allowing water infiltration and build-up of debris/silt surrounding the containment sump. The water/silt build-up may also damage the cover or lid assembly and other components of the sump, making any initial water tight capability obsolete, and thus allowing debris, silt, or water to infiltrate the sump, thus damaging components in the sump and increasing the probability of the water, silt, and debris infiltrating the underground storage tank. Further, when the sump is not water tight it can flood, introducing contaminants to the area outside of the sump, which is often a release point to the environment (soil, groundwater). Spillage of even the smallest amounts build-up over the lifetime of the underground storage tank system and create certain far-reaching environmental problems.

While some attempts have been made to design new systems to prevent water infiltration into UST containment sumps, these systems have various drawbacks, some of which are discussed below, and are not adapted to inexpensively remedy the hundreds of thousands of existing UST's that presently have conventional non-water-tight containment sumps.

For example, U.S. Pat. No. 4,655,361 ('361 patent), which issued to Clover et al., incorporated herein by reference, discloses a Containment Tank. The '361 patent refers to a secondary containment tank and manhole cover assembly. The assembly provides access to a fill pipe for a main underground storage tank and purports to prevent overflow of excess volatile liquid such as gasoline into the ground. The containment tank includes an upper ring or rim secured on an in-ground vertical skirt supported in a concrete base. An inner container is secured to the vertical skirt and has an open end adjacent to the upper ring. The cover fits into and is supported on a horizontal flange or step of the upper ring over the opening of the inner container and includes a vertical ring extending downwardly from the underside of the cover into a space between the inner container and vertical skirt. The vertical ring on the cover extends below the level of the container opening and thus is supposed to bypass surface water leakage through the upper ring around the cover into the space adjacent to the container and into the ground below. The upper containment tank also includes means such as a manually operable sump pump or drain valve to empty excess liquid into the fill pipe of the main storage tank. The system disclosed in the '361 patent would not prevent flooding of the tank in the event of flooding and/or water/silt build-up.

U.S. Pat. No. 4,706,718 ('718 patent), which issued to Milo, incorporated herein by reference, discloses a Containment Manhole having Spillage Sealing Means. The '718 patent refers to a containment manhole comprising a hollow body having a closed bottom and an open top. A concentric opening is provided in the bottom to receive an underground tank fill there through and a circular, resilient seal is provided to seal the junction between the tank fill and the manhole bottom. Optionally, a drain valve may be provided in the manhole bottom to lead any spillage directly back to the tank fill. The manhole terminates upwardly in the machined ring and includes a gasketed junction with the ring. The ring includes an upper shoulder upon which the cover peripheral lip can rest and a lower shoulder of size to enable the cover peripheral edges to rest. An O-ring seal is provided intermediate the cover and the top ring to provide a first sealed junction and a circular gasket is affixed on the lower ring edge to provide a second seal when the cover is in position. In practice this system would be expensive and failure prone. For instance, typically cast iron manhole covers and receptacles would have to be precisely machined to accept a very large and expensive rubber o-ring, which is placed in an orientation and location that would cause it to readily fail in use due to abrasion, wear and tear, and degradation by water/silt sitting right against the sealing surface. Systems utilizing separate manhole covers and sump covers are more practical.

U.S. Pat. No. 4,717,036 ('036 patent), which issued to Dundas et al., incorporated herein by reference, discloses a Liquid Tank Spillage Control System. The '036 patent refers to a spill control device for underground liquid storage tanks having an upwardly extending fill pipe. The control device comprises a steel, epoxy coated, and liquid collecting spill tank having a riser tube that extends upward through the tank bottom. A circular seal ring fits about the upper end of the riser tube and about the outer wall of a fill pipe received through the riser tube. A clamp compresses the seal about both the riser tube and fill pipe. A cover is provided which covers the access opening in the top of the spill tank. A first basin surrounds the cover for channeling precipitation, and other liquids impinging the cover, away from the spill tank. A valve is disposed on the fill pipe for selectively directing liquids discharged into the spill tank into the storage tank. A second basin surrounds the spill tank for recovering liquids discharged from the spill tank during a filling operation. The system disclosed in the '036 patent would not prevent flooding of the tank in the event of flooding and/or water/silt build-up.

U.S. Pat. No. 4,762,440 ('440 patent) and U.S. Pat. No. 4,842,443 ('443 patent), both of which issued to Argandona, both of which are incorporated herein by reference, disclose certain Spill Containment Device(s). The '440 and '443 patents teach spill containment devices for the fill tube of a liquid storage tank, particularly an underground, liquid storage tank. The containment devices each have a spill container with a bottom opening for receiving the tank fill tube in liquid sealing relation to the container wall and a top opening through which the fill tube is accessible for filling the tank, whereby the container is supposed to contain liquid spilled during filling of the tank. The container top openings are closed by removable covers which cooperate with a water drain arrangement to vent liquid vapor from the containers while purportedly preventing rain and other ground surface water from entering the containers. A drain valve operable from a position adjacent each container top opening is provided for draining liquid spill from the respective container to the tank. One embodiment is designed to receive multiple tank fill tubes and has a surrounding casing with a relatively massive top end closure having openings closed by separate relatively small covers which are individually removable to access the different tank fill tubes. The system disclosed in the '440 and '443 patents would not prevent flooding of the tank in the event of flooding and/or water/silt build-up.

U.S. Pat. No. 5,058,633 ('633 patent), which issued to Sharp, incorporated herein by reference, discloses a Containment Assembly for Fill Pipe of Underground Storage Tanks. The '633 patent refers to an assembly intended for use on underground storage tanks. The assembly provides ready access to a fill pipe from ground level. At the same time the assembly serves as a spill containment means for accidental spillage and a secondary containment means for the fill pipe. The assembly of the invention comprises a secondary containment chamber having a sidewall with means for attaching to the storage tank. An anchor ring which is attached to an upper open end of the containment chamber acts as a permanent ground base for the assembly. A bridging surface cover within the anchor ring has a removable lid positioned in its interior portion to gain access to the chamber's interior for a filling operation. The assembly also comprises a fill pipe for delivering liquid to the storage tank. The fill pipe is positioned within the secondary containment chamber with a discharging end extending through the chamber's bottom and a receiving end terminating within the chamber but near the bridging surface cover. An open top spill compartment is positioned within the secondary containment chamber and at the receiving end of the fill pipe so as to encompass the fill pipe's receiving end for the purpose of catching spilled liquid from the filling operation. The spill compartment also is supposed to prevent the spilled liquid and vapors from entering the secondary containment chamber. While sealing the bottom of the secondary chamber is discussed in the '633 patent, the disclosed system would not prevent flooding of either chamber in the event of flooding and/or water/silt build-up.

U.S. Pat. No. 5,222,832 ('832 patent), which issued to Sunderhaus et al., incorporated herein by reference, discloses Spill Containment Devices and Their Installation. The '832 patent refers to a below grade, spill containment device for connection with the riser pipe of an underground fuel storage tank. The containment device is disposed within and isolated from a manhole, which is mounted in a concrete apron. The containment device comprises a compositely formed container, rigidly mounted on the riser pipe. The specially-designed container formed of structural synthetic resin material elements held in assembled relation by snap fitted lugs and notches. A complicated lid assembly, for closing the upper, access opening, includes a pivotable arm. A lever pivoted on the arm selectively engages latch means to lock the lid in a closed position. A projection on the lever prevents the manhole cover from seating if the lever is not in its lock position. A valve for draining fuel from the container to the riser pipe is closed when the lid is open and opened when the lid is closed. The manhole and the containment device are packaged in a shipping carton in spaced relation be corrugated paper sheets. These sheets are employed in obtaining a desired relation between the containment device and manhole in the installation of these components, which involve pouring a concrete apron around the upper end of the manhole. An alternative system employs adjusting nuts to obtain this relationship between the manhole and containment device. This adjusting nut structure pushes down on the lid, but is removed upon installation of the structure. In one embodiment the manhole is compositely formed to permit relative movement between its upper and lower portions, after installation. The '832 patent thus provides one way to attempt to seal a sump lid, but it requires a specially-designed sump container, as well as a very complicated and expensive latching mechanism. The system described in the '832 patent could not readily be used to retrofit existing conventional sumps.

U.S. Pat. No. 7,171,994 ('994 patent), which issued to O'Brien, incorporated herein by reference, discloses a Spillage Containment System and Kit for Underground Storage Tanks. The '994 patent refers to a matter-isolating system for use in combination with an underground storage tank assembly that comprises primary and secondary spillage containment assemblies and a double-walled manhole assembly. The manhole assembly comprises a manhole lid, an outer skirt wall, and an inner skirt wall. The inner skirt wall defines an inner manhole cavity and an outer manhole channel. The outer manhole channel is designed to direct moisture from the lid to certain backfill material in an attempt to isolate the inner manhole cavity from channel-directed moisture. The spillage containment assemblies form concentric primary and secondary spillage-containing chambers in radial adjacency to a tank access conduit of the underground tank assembly. The inner manhole cavity functions to isolate the secondary spillage containment chamber from the outer manhole channel and the primary spillage containment chamber isolates the secondary spillage containment chamber from the tank access conduit. A chamber-monitoring system may be incorporated into the system for monitoring the isolated chambers. The inner manhole cavity, or sump, is provided with a lid having a gasket, but no means is provided to compress the gasket and create a seal, except during temporary pressure testing. The system disclosed in the '994 patent would not prevent flooding of the tank in the event of flooding and/or water/silt build-up.

U.S. Pat. No. 5,595,456 ('456 patent), which issued to Berg, et al., incorporated herein by reference, discloses a Water-Tight Riser For Underground Storage Tank Manway. The '456 patent refers to an underground storage tank provided with a manway equipped with a specially-designed riser or sump extending from the storage tank, about the manway, to a point just below the access way provided in the ground level of the installation. The riser/sump is provided with a "water-tight" domed-shaped cover that is released through operation of a cam mechanism. The riser/sump is intended to exclude water from the interior of the riser/sump and the manway, ensuring access to the manway, operation of the fittings provided in the manway, and an additional containment of fluid passing through the manway and the area of the tank adjacent thereto. An alarm sensitive to liquid may be placed in the interior of the riser to alert the operator to the possible loss of containment, or loss of water-tight sealing between the cover and the riser. Because the '456 patent requires a riser or sump with a horizontal top flange specially configured to mate with a radial clamp, it is not adapted to retrofit the hundreds of thousands of existing UST's that have conventional sumps, which lack this feature. And sump replacement on a buried UST would not normally be feasible, since typical sumps are permanently attached to the UST as originally formed or by application of resinous material.

U.S. Pat. No. 7,043,965 ('965 patent), which issued to Schneider, incorporated herein by reference, discloses a Double-Walled Containment Enclosure. The '965 patent refers to a containment enclosure system at least a portion of which is double-walled. An exemplary system of the invention provides enhanced leak protection by monitoring the space within the double-walled portion of the containment enclosure system. The system is designed to be capable of providing continuous monitoring of the enclosure, collar, penetrations, and/or joints for potential leaks. Several examples are shown of a double-walled containment sump sealed against a double-walled lid such that the spaces within the double-walled portions of the sump and lid are in fluid communication with each other. The examples rely primarily on radial compression of gaskets or O-rings between a vertical lip on the lid and the vertical wall of sump. To effectuate a water-tight seal in such a manner requires significant force. While the '965 patent's thick double-walled components might be able to be designed to withstand such high radial forces, conventional single-walled plastic sumps would simply deflect and deform if attempted to be sealed in this manner, preventing a water-tight seal. For that and other reasons, the '965 patent is not adapted to retrofit existing UST's with conventional single-walled sumps. And sump replacement on a buried UST is not normally feasible as discussed above.

Accordingly, what is needed is a practical system and method for cost-effectively sealing containment risers/sumps, including a system and method for retrofitting existing UST's that have conventional containment risers/sumps, to create a long-lasting, water-tight seal between the riser/sump and its removable lid or cover. Means are also needed to minimize unnecessary instances of lid/cover removal.

SUMMARY OF THE INVENTION

The aforementioned issues are addressed to a great extent by the present invention, which provides a system for sealing the interface between: (1) a sump used in connection with an underground storage tank, the sump having an outer surface defining an exterior, an inner surface defining an interior, the outer surface defining an opening into the interior of the sump; and (2) a cover adapted to cover the opening. The system may include an expansion ring assembly adapted to affix to the interior of the sump, the expansion ring assembly further adapted to fastenably attach with the cover. The cover is adapted to fastenably attach with the expansion ring assembly, and at least one seal is adapted to seal the interface between the opening and the cover when the expansion ring assembly is affixed to the interior of the sump and the cover is fastenably attached with the expansion ring assembly. The expansion ring assembly may affix to the interior of the sump by expanding against the inner surface of the sump. The seal is preferably a water-tight seal.

Also provided is a contraction band assembly adapted to affix to the exterior of the sump opposite the expansion ring assembly, for instance by contracting against the outer surface of the sump.

The cover may include an observation portal that allows a user outside the sump to see through the observation portal into the interior of the sump when the cover is covering the opening.

Methods of using the system are described, including for instance the step of machining surfaces of the sump that will come in contact with the seal.

BRIEF DESCRIPTION OF THE DRAWINGS

The aforementioned advantages and features of the present invention will be more readily understood with reference to the following detailed description and the accompanying drawings in which:

FIG. 5 shows an example expansion ring assembly, where FIG. 5A is a top plan view, FIG. 5B is a side elevation view, and FIG. 5C is a bottom plan view thereof.

FIG. 6 shows an example contraction band assembly, where FIG. 5A is a top plan view, and FIG. 6B is a side elevation view thereof.

FIG. 7 shows an example sump cover with an optional observation portal, where FIG. 7A is a top plan view, FIG. 7B is a side elevation view, and FIG. 7C is a bottom plan view thereof.

DETAILED DESCRIPTION

In the following detailed description, various specific details, such as certain geometries and materials, are recited to provide a thorough understanding of specific examples of the present invention. These examples should not be understood to limit the present invention, which is intended to be defined solely by the claims. Further, certain method steps are delineated as separate steps for ease of understanding; however, these steps should not be construed as necessarily distinct nor order-dependent in their performance, unless otherwise indicated.

1. Typical Existing Underground Storage Tank Installations

Figure 1:
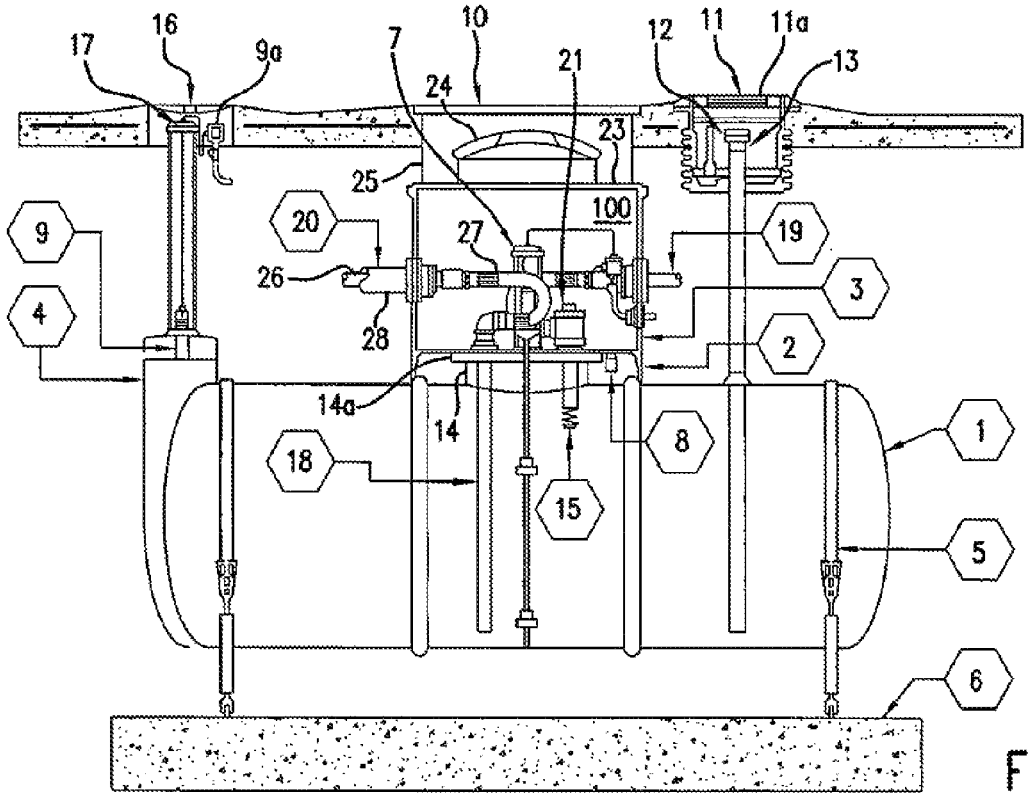
FIG.1 PRIOR ART
FIG. 1 is a side-elevation view of a conventional gasoline underground storage tank installation.

FIG. 1 illustrates a typical underground storage tank installation, in this case, a gasoline tank installation. A double walled underground storage tank ("UST") 1 is secured by a pair of retaining straps 5 attached to a pair of deadmen 6 (one of which is visible in FIG. 1). As is well known in the art, the straps 5 and deadmen 6 are sometimes necessary to prevent flotation of the UST 1 in the presence of a high water table. Other types of retaining systems, including above and below ground slabs, may also be present.

The example double-walled UST 1 includes a hydrostatic monitoring system 4. The hydrostatic monitoring system monitors the level of a monitoring fluid, typically brine, between the two walls of the double walled UST 1. The hydrostatic monitoring system 4 includes a monitoring sensor 9 connected to a communication module 9*a* through tube 17. The tube 17 is accessible via manhole 16. The hydrostatic monitoring system 4 is used with a double walled UST 1 with a wet annulus. However, the present invention is not limited to USTs with wet annulus monitoring systems and may also be used with a UST having a dry annulus or an annulus that is slightly pressurized either negatively or positively. In fact, various embodiments of the present invention may be applicable to sealing covers on sumps on any type of UST.

The interior of the example UST 1 may be filled from ground level by removing the cover 11*a* from the spill containment sump 11, which provides access to the fill cap 12 covering the fill tube 13.

The example UST 1 includes a collar 2 to which is attached a riser 3. The collar 2 and riser 3 surround a manway 14 covered by a manway cover 14*a*. A riser top 23 sits atop the riser 3. The riser top 23 includes a removable cover 24. The collar 2, riser 3, riser top 23 and cover 24 together form an example sump 100. An access way 25 and ground level access way cover 10 provide access to the sump cover 24. The access way 25 and access way cover 10 are not part of the sump and are generally not kept water-tight.

A level probe 7 is disposed within the example sump 100 and passes through the manway cover 14*a* to monitor the level of fluid within the UST 1. A single walled vent pipe 19 is connected to the housing for the level probe 7 and passes through the wall of the riser 3 to provide venting for the UST 1. Also disposed within the example sump 100 is an extractor assembly 21, which is connected through the manway cover 14*a* to ball float 15 in the interior of UST 1.

A double walled pipe 20 carries gasoline to the example UST 1. The double walled pipe 20 passes through a side of riser 3. The interior wall 26 of double walled pipe 20 is connected, via flex connector 27, to a pipe 18 passing through the manway cover 14*a* to the interior of the UST 1. The space between the outer wall 28 and inner wall 26 of double wall pipe 20 is in fluid communication with the sump 100. As discussed above, any fluid leaking from interior wall 26 of double wall pipe 20 will be contained by outer wall 28 and transported to sump 100 for containment. An example sensor 8 detects fluid in sump 100 and triggers an alarm system (not shown).

As discussed above, a leak in the sump 100 has the potential to compromise the containment of fluid leaking from the interior wall 26 of double wall pipe 20. For example, water, silt and other contaminants may flow downward past access way cover 10, and can build-up around and/or at least partially submerge riser top 23 and sump cover 24. If sump cover 24 is not sealed against a flood or otherwise develops a leak, then the adjacent water, silt and other contaminants can flow into sump 100, damaging the components therein, and triggering the alarm system, which requires remediation and can have regulatory consequences. Further, when there is a leak in the sump 100, any fuel or other environmentally hazardous materials already in the sump 100 may mix with water flooding the sump 100, and flow out of the sump 100 and into the surrounding environment. Accordingly, it is critical to maintain a water-tight seal between the removable sump cover 24 and the adjoining walls 23 of the sump 100.

2. Typical Existing Sump Assemblies

Figure 2:
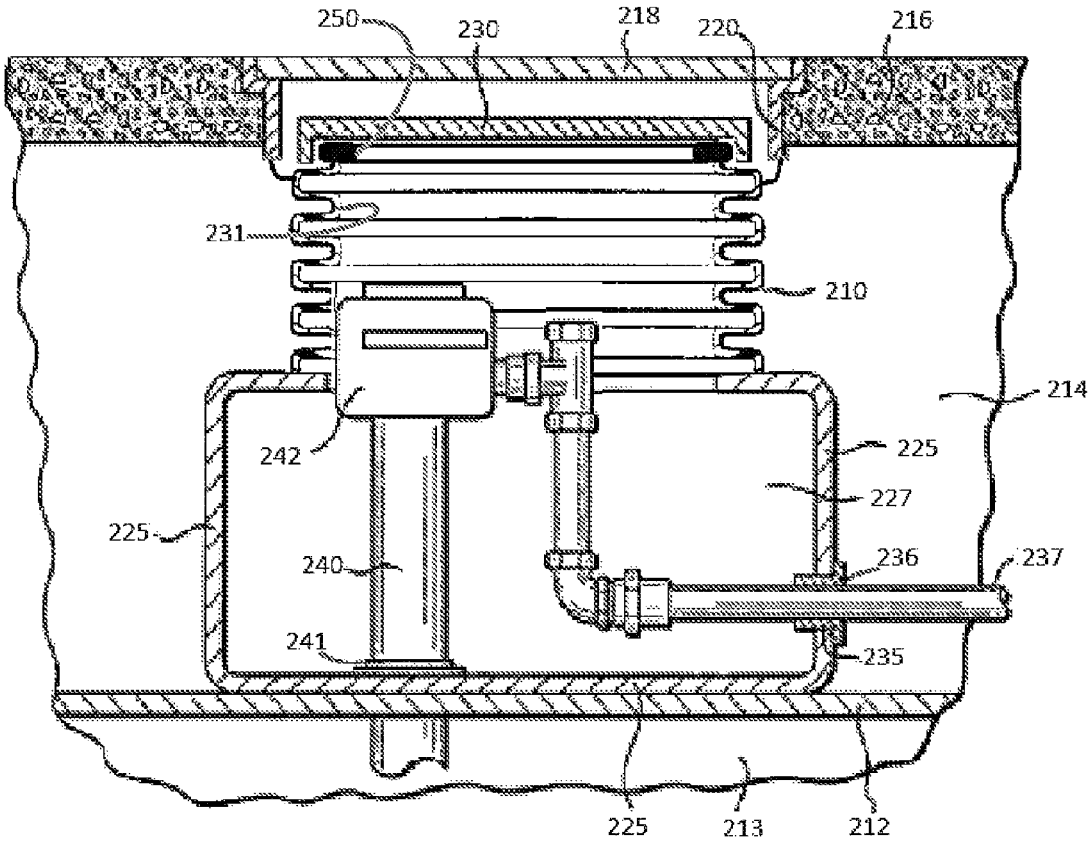
FIG. 2 is a side-elevation, cross-sectional view of a sump mounted on a storage tank, shown in an underground environment.

While FIG. 1 does not show the details of the interface between the removable sump cover 24 and the adjoining walls 23 of the sump 100, FIG. 2 shows a typical arrangement as presently found in the field. In FIG. 2 a sump 210 is mounted on the wall 212 of an underground storage tank 213. The sump 210 is buried at least partially in dirt or gravel 214. In a traditional gas station setting, the sump 210 is mounted underneath pavement or concrete 216. Access to the sump 210 is available through a manhole cover 218 that is mounted onto a manhole ring 220 that is fixed in the pavement or concrete 216.

The sump 210 is typically formed from a polymer material, usually polyethylene, and sometimes fiberglass, and includes a sidewall 225 that defines a chamber 227 therein. The sidewall 225 of a sump 210 typically includes one or more openings 235 in which are mounted fittings 236 and pipes 237 that pass through the sidewall 225. The fittings 236 are of a material and fit appropriate to create a seal of the opening 235 in the sidewall 225. Inside the sump chamber 227, there is frequently sensitive equipment, such as a pump 242 that includes a pipe 240 and pipe fitting 241 that feed down into the underground fluid storage tank 213 through sidewall 225 and the underground fluid storage tank wall 212. Sump chambers 227 also include sensors (not shown) that sense the presence of and/or amount of liquid present inside the sump chamber 227. The sensors trigger local and/or remote alarms that must be promptly addressed when liquid is present in the sump chamber 227.

Sumps 210 have an upper wall 231 that defines an opening that is covered by a sump cover or lid 230. The upper wall 231 is frequently ribbed for strength, as shown in FIG. 2, especially where the sump 210 is formed from the relatively flimsy material polyethylene. However, the upper wall might not be ribbed and may have any suitable geometry, and may define a circular opening (most typical), or an opening having a polygon shape, or any other suitable shape. In any event, the typical means used to attempt to seal a removable sump cover 230 to adjoining walls 231 of a sump 210 are, in practice, grossly inadequate and not water-tight, and often consist of the sump cover 230 simply resting by force of gravity on a compliant piece of material such as foam or rubber 250 situated on the top edge of sump wall 231. Attempts to apply sufficient force to typical sump covers 230 to pinch resilient material 250 to create a water-tight seal against the top edge of sump wall 231 have in the past usually been ineffective, due in large part to the inferior mechanical properties of the polymer materials being joined, such as lack of strength and dimensional instability.

The foregoing description of a sump installation is typical of the construction of sumps on many thousands of existing UST installations. But as noted earlier, these and similar constructions are not effective at preventing water seepage into the sump chamber 227 in the event of flooding and/or water/silt build-up adjacent the sump cover 230. The present invention addresses this important environmental issue by providing a system adaptable to create effective water-tight seals for a wide variety of sumps and covers, as now discussed with respect to FIG. 3.

3. Example Embodiment of System for Sealing Sump Covers

Figure 3:
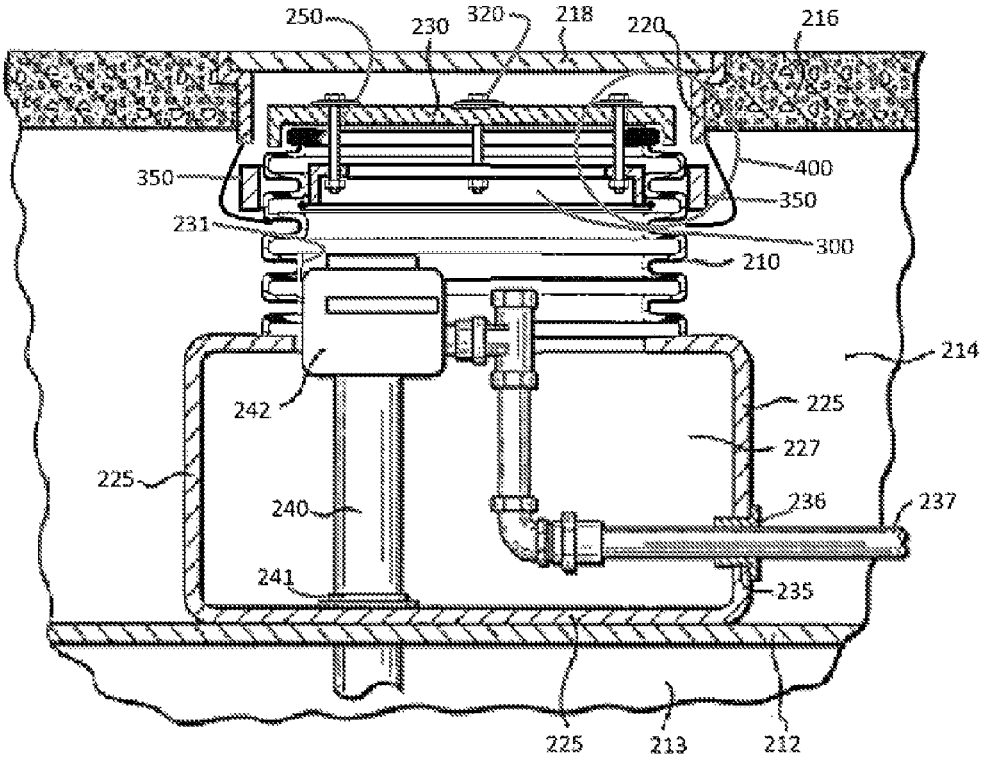
FIG. 3 is a side-elevation cross-sectional view of the sump shown in FIG. 2, further displaying one example embodiment of a system for sealing sump covers.

FIG. 3 shows one example embodiment of the present invention, which can also be carried out in alternative fashions as would occur to a person of ordinary skill in the art. In the example shown in FIG. 3, the example sump 210 shown in FIG. 2 has been modified by adding several features.

a. Example Expansion Ring Assembly

Figure 4:
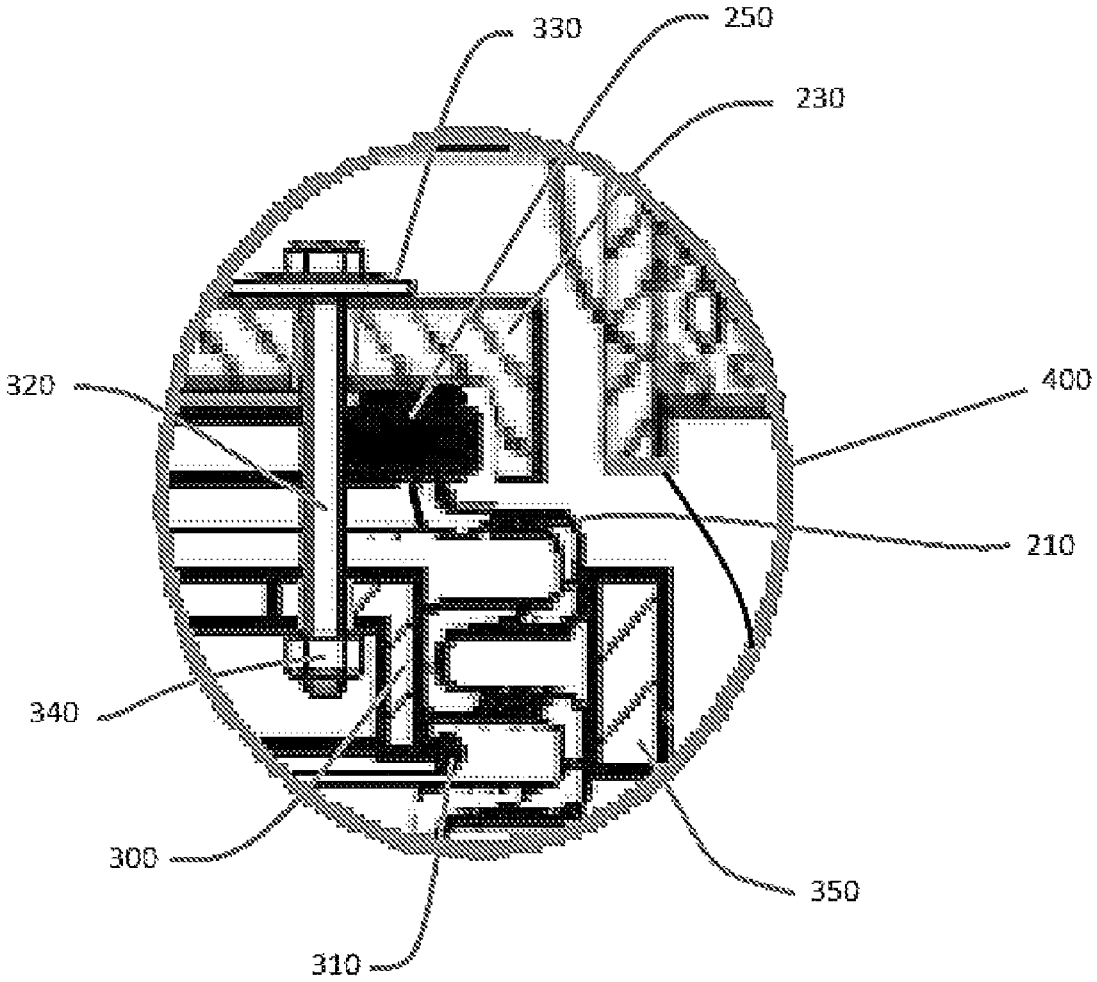
FIG. 4 is a detail view of a portion of FIG. 3, shown in larger-scale.

First, an expansion ring assembly 300 has been added to the interior of the upper wall 231 of the sump 210. As shown in more detail in FIGS. 4 and 5, the expansion ring assembly 300 in this example embodiment is formed from a piece of rigid material, such as angle iron, bent into a circle—FIGS. 5A, 5C—having an outer diameter selected to forcibly engage against the inner diameter of the upper wall 231 of the sump 210, as shown in FIGS. 3, 4. In one embodiment the expansion ring assembly 300 is formed from two-inch by two-inch hot-rolled mild steel angle iron, which may be bent by well-known metal forming methods into a wide range of circle diameters, typically from twenty-eight inches to forty-two inches in diameter. As shown in FIGS. 3, 4, the angle iron used in this embodiment is oriented such that the vertically-extending portion of the angle iron extends upward, and the horizontally-extending portion of the angle iron extends radially inward. The expansion ring assembly 300 includes at least one fastener retention means 319 in the horizontally-extending portion, such as but not limited to, bolt clearance holes, tapped and threaded holes, and/or holes with press-fit fasteners (not shown) installed. In one embodiment, the expansion ring assembly 300 includes eight (8) approximately equally-spaced holes drilled and tapped to accept ½"-13 bolts. To strengthen threaded holes in expansion ring assembly 300, steel gussets, for instance, round or square pieces of steel ⅛" thick (not shown), may be welded to expansion ring assembly 300 at the locations where the holes will be drilled and tapped, i.e., to make the material thicker at the location of the threaded holes.

In the particular embodiment shown in FIGS. 3-5, which is adapted to interface with a ribbed upper wall 231 of a sump 210, the expansion ring assembly 300 further includes a ledge 310 that encircles and extends radially outward beyond the outer diameter of the angle iron, as best seen in FIGS. 4 and 5B. The optional ledge 310 is meant to engage the ribbed upper wall 231 of the sump 210 as shown in FIGS. 3 and 4, to help secure the expansion ring assembly 300 from moving vertically relative to the ribbed upper wall 231 of the sump 210. In one embodiment the ledge 310 is formed from commercially available steel reinforcing bar, or rebar, having a nominal diameter of ⅜" or ½," and is welded to the angle iron. Additional features may be provided to help secure the expansion ring assembly 300 against the interior wall 231 of a sump 210. In one embodiment, the vertically-extending portion of the angle iron includes eight (8) ¼-20 threaded holes (not shown) distributed approximately evenly around the expansion ring assembly 300 to allow set screws or the like (not shown) to be installed to help secure the expansion ring assembly 300 against the interior wall 231 of a sump 210, for instance during installation.

The primary way the expansion ring assembly 300 is secured to the interior wall 231 of a sump 210 is by expanding the diameter of expansion ring assembly 300 after installation in the sump 210. The diameter of expansion ring assembly 300 may be expanded because it has a gap, 314, as shown in FIG. 5A. In this example, actuating one or more threaded actuators 311 applies a force urging first gusset 312 to spread away from second gusset 313, thereby increasing the gap 314 and thus the overall outer diameter of the expansion ring assembly 300. In one embodiment this is accomplished with one or more ½" diameter spreader bolts 311 passing through 9/16" diameter through holes in first gusset 312 and second gusset 313, which gussets may be square or other-shaped steel plates welded into position to the expansion ring assembly 300 as shown in FIG. 5B. In one embodiment, actuator(s) 311 comprise ½"-13×4.5" long threaded stock each having four ½"-13 locking nuts thereon (not shown) between the first gusset 312 and second gusset 313, so that the nuts can be turned to urge outwardly against first gusset 312 and second gusset 313, and then locked in place. Alternatively, actuator 311 may be a bolt or screw that engages a threaded hole in first gusset 312 and pushes against second gusset 313. Any mechanism that accomplishes the goal of sufficiently modulating the gap 314 may be used. In one embodiment the gap 314 starts out at approximately one inch (1") wide before being expanded. The expansion ring assembly 300 may be powder coated or otherwise coated or painted to protect it from corrosion. Corrosion-resistant materials such as stainless steel may optionally be used for fasteners and other hardware.

b. Example Contraction Band Assembly

While expansion ring assembly 300 is designed to provide a strong and dimensionally stable anchor to which the sump cover 230 can be fastened, the radially outward force it may apply to the walls 231 of the sump 210 may cause the walls 231 of the sump 210 to deform, break, or otherwise fail, especially where relatively weak material like polyethylene is used for the walls 231 of the sump 210. Accordingly, as shown in FIGS. 3, 4 and 6, an optional contraction band assembly 350 is provided to surround the outer diameter (or contour) of the walls 231 of the sump 210 adjacent the expansion ring assembly 300, to provide support and radially inward force against the walls 231 of the sump 210 to counteract the radially outward force thereon created by the expansion ring assembly 300.

As shown in FIG. 6, contraction band assembly 350 may comprise a ring or band having a gap 355. The thickness of the band 350 shown in FIGS. 3, 4 and 6 is exaggerated for clarity of viewing. In one embodiment the contraction band is ¾" wide (in the vertical direction in FIGS. 3, 4) stainless steel (such as 201, 202, 304 or 316L stainless steel) that has a nominal thickness (in the horizontal direction in FIGS. 3, 4) of approximately 0.030," or 0.76 mm. Where needed, the contraction band 350 is preferably pulled tight around the exterior of walls 231 of the sump 210 prior to expanding the expansion ring assembly 300. In one embodiment there is no gap 355; rather, the band 350 overlaps itself and is pinched together with a ¾" 201 stainless steel set screw locking buckle (not shown). Such a set screw locking buckle is available from Grainger, Inc., on the Internet at www.grainger.com (Grainger Item #2LNV1, Brand BAND-IT, Mfr. Model # GRC726). Alternatively, any other mechanism can be used to pull the band 350 tight, such as threaded fasteners 353 passing through a first band gusset 351 and a second band gusset 352 into nuts 354, which, when tightened, decrease the distance 355 and reduce the inner diameter of band 350, as shown in FIG. 6.

c. Example Sump Cover

An example sump cover 230 is shown in FIG. 7. Sump cover 230 may be made from any suitable material, such as metal or a polymer. In one embodiment the sump cover 230 is made out of fiberglass. Sump covers 230 are formed to correspond to the diameter (and, if not round, the shape or profile), of the mating containment sump 210. Diameters in the range of 28 inches to 42 inches are typical. In one embodiment sump cover 230 is ⅜" thick solid fiberglass, except the optional turned-down outer lip portion 231, which in that embodiment turns vertically down for 2 inches and is ¼" thick. The sump cover 230 may be flat on top, as shown in FIGS. 3, 4 and 7, or may have any other profile, including but not limited to domed, conical, pyramidal, or any other shape. In one embodiment, sump cover installation and/or removal instructions, or a compartment therefore, are laminated or molded directly into the top of the sump cover 230.

Example sump cover 230 includes four fastener through holes 232 corresponding in number and location to the fastener retention means 319 in the horizontally-extending portion of the expansion ring assembly 300 shown in FIG. 5. In one embodiment the sump cover includes eight (8) approximately equally spaced through holes sized to clear ½" bolts. In one embodiment the anchor bolts 320 are ½-13×6" long, zinc coated, and have solid flanged heads to provide a sealing surface for the sealing means 330. Any suitable fasteners may be used, however, according to the sealing means 330 used. As shown in FIGS. 3 and 4, anchor bolts 320 pass through sealing means 330, such as rubber grommet seals or other sealing devices, such as properly-sized Stat-O-Seal rubber-bonded-to-metal washers, available from Parker-Hannifin Corporation. In one embodiment, anchor bolts 320 then pass through holes 232 in the sump cover 230, and then thread into the fastener retention means 319 in the horizontally-extending portion of the expansion ring assembly 300 (alternatively, where the expansion ring assembly 300 does not provide threaded holes but rather through holes, a nut 340, shown in FIG. 4, such as a press-fit nut, may be provided to secure anchor bolts 320). In certain embodiments the anchor bolts 320 or other fastening means may have small holes drilled through their top portions to permit safety wire to be placed there through, for the purpose of sealing off the assembly so that the responsible party can determine whether the cover 230 has been removed.

In one embodiment the sealing means 330 include flexible push-in rubber grommets with ½" inner diameter and 1 1/16" outer diameter, which have provided a water-tight seal. Such grommets may be used to seal on the interior and exterior sides of the sump cover 230.

d. Example Sump Cover Seal

As shown in FIGS. 3 and 4, the sump cover's primary seal, resilient material 250, is compressed between the sump cover 230 and the top of the upper walls 231 of sump 210 when the anchor bolts 320 are screwed into the fastener retention means 319 of the horizontally-extending portion of the expansion ring assembly 300. The strength and rigidity of the reinforced structure disclosed herein allows significant and uniform force to be applied to resilient material 250, thereby promoting a water-tight seal between the sump cover 230 and the top of the upper walls 231 of the sump 210. In one embodiment the resilient material 250 is ⅜" thick×2" wide foam rubber seal (Gasoline & Oil Resistant) that is affixed to the interior of the sump cover 230. Suitable materials for resilient material 250 may include, among other things, Nitrile (AKA Buna or Buna-N), Ethylene Propylene Diene Monomer (E.P.D.M.), for instance in the form of closed-cell sponge rubber with pressure sensitive adhesive on one side (to be placed against the sump cover 230). Such material is available from Rubber-Cal, Inc. of Santa Ana, Calif. While examples are provided regarding resilient material 250, any suitably resilient material and geometry that effectuates a water-tight seal can be used.

e. Example Observation Portal

To save considerable time doing maintenance inspections, one optional aspect provided by the present invention is an observation portal configured in the sump cover 230, an example of which is shown in FIG. 7. An example observation portal assembly 233-237 provides the option of looking into the sump 210, to visually check for leaks and the like, without having to take the time to unfasten and remove the sump cover 230. Further, reducing the number of removals and replacements of the sump cover 230 tends to increase the life and effectiveness of the resilient material 250. In the embodiment shown in FIG. 7, the example observation portal assembly 233-237 comprises a through hole 233 in the sump cover 230, the through hole 233 covered on top by a transparent member 234, such as ⅜" thick by 8" diameter piece of clear Lexan material. The transparent member 234 can be attached to sump cover 230 by any water-tight means. In one embodiment the transparent member 234 is attached to the sump cover 230 with four plastic Rosette-head thumb screws 236 that are ¼-20×2" long, and screw into rivet flange nuts 237 with matching ¼-20 thread. In that embodiment the transparent member 234 has four 5⁄16" diameter through holes drilled on a 3" radius from center line on even "X" "Y" axes to evenly space the fasteners. The rivet flange nuts 237, while visible in the bottom of sump cover 230 in FIG. 7C, may not be visible in some embodiments, for instance where they are inserted into the top of sump cover 230 in ⅜" blind holes that have been predrilled into the top of sump cover 230. Such rivet flange nuts 237 are designed to be collapsed in the fiberglass lid to give a compression fit to keep them from spinning when tightening thumb screws 236. To prevent liquids from seeping between the transparent member 234 and the sump cover 230, a seal 235 (indicated but not shown in FIG. 7B) is provided between the transparent member 234 and the sump cover 230. In one embodiment the seal 235 is formed from a ⅜" thick by 1" wide piece of the same material used for the sump cover's primary seal, resilient material 250, discussed above. The seal 235 should seal the area between the fasteners 236 and the through hole 233 in the sump cover 230.

4. Other Embodiments of System for Sealing Sump Covers

Alternative geometries that perform the required function of providing a strong and dimensionally stable anchor to allow a sump cover 230 to be removably and sealably fastened to the upper walls 231 of a sump 210 are contemplated, and would be apparent to a person of ordinary skill in the art upon reading this disclosure. Accordingly, all such alternative structures and are intended to fall within the scope of this invention, which is to be limited only by the scope of the claims. For example, in some embodiments the expansion ring assembly 300 may be shifted from the inside of the sump 210 to the outside of the sump 210, replacing contraction band assembly 350. In those embodiments the revised expansion ring assembly 300' (not shown) would be inverted, or bent outward instead of inward, so that the horizontally extending portion with the fastener receiving means 319 would extend radially outward, away from the sump 210, while the vertically extending portion of the revised expansion ring assembly 300' would be facing radially inward, to interface with the outer surface of the sump 210. In those embodiments the diameter adjustment mechanism 311-314 would be reversed, so that the mechanism urged the gap 314 to get smaller and contract around the sump 210. In that case another, conventional expansion ring assembly 300 could be placed inside the sump 210, in its previously-discussed location, to counteract the radially-inward compression forces of the revised expansion ring assembly 300.' This might be done for instance where there is room around the sump 210 to do so, so that the fasteners 320 would be relocated radially outward, outside of the sump 210 (thus eliminating potential leak paths into the sump). Alternatively, a completely different structure separate and apart from angle iron and rebar could be used to achieve the same effect, without departing from the scope and spirit of the invention, which is limited only by the claims.

5. Example Embodiment of Method for Sealing Sump Covers

Various steps related to sealing sump covers 230 will now be described. First, a sump 210 used in connection with an underground storage tank 213 is identified as either leaking liquid into or out of the sump 210 at the sump cover 230, or is likely to leak at the sump cover 230 location. The manway or manhole cover 218 above the sump 210 is removed and the sump 210 revealed. The existing sump cover 24, if any, is removed. The sump 210 is cleaned out and maintained as desired. If needed, the uppermost edge of the upper wall 231 of the sump 210 is planed flat using conventional planning equipment, and/or deburred, or any other machining process is performed on the surface to improve its ability to form a seal against seal 250. A contraction band assembly 350 adapted to fit against the outside of sump 210 is placed around the outside of the sump 210 and tightened against the outer diameter of the sump 210, for example as shown in FIGS. 3, 4 and 6. An expansion ring assembly 300 adapted to fit against the inside of the sump 210 is placed in the sump 210, adjacent the location of the contraction band assembly 350, and is expanded against the inner surface of the sump 210 until the expansion ring assembly 300 is firmly affixed to the sump 210, for example as shown in FIGS. 3, 4 and 5, the expansion ring assembly 300 being adapted to be fastenably attached with a sump cover 230. A sump cover 230 is provided, the sump cover 230 adapted to be fastenably attached with the expansion ring assembly 300, the sump cover 230 having a seal 250 adapted to seal the interface between sump cover 230 and the sump 210 when the sump cover 230 is fastenably attached with the expansion ring assembly 300. The sump cover 230 is fastenably attached to expansion ring assembly 300, causing the seal 250 to seal the interface between sump cover 230 and the sump 210.

Alternatively, after the sump 210 is prepared as discussed above, an expansion ring assembly 300 adapted to fit against the inside of the sump 210 is placed in the sump 210, adjacent the location of the contraction band assembly 350, and is expanded against the inner surface of the sump 210. Then, instead of using a contraction band assembly 350, a modified expansion ring assembly 300' adapted to fit against the outside of sump 210 is placed around the outside of the sump 210 and tightened against the outer diameter of the sump 210 until the expansion ring assembly 300' is firmly affixed to the sump 210, as discussed previously, the modified expansion ring assembly 300' being adapted to be fastenably attached with a sump cover 230. A sump cover 230 is provided, the sump cover 230 adapted to be fastenably attached with the modified expansion ring assembly 300', the sump cover 230 having a seal 250 adapted to seal the interface between sump cover 230 and the sump 210 when the sump cover 230 is fastenably attached with the modified expansion ring assembly 300'. The sump cover 230 is fastenably attached to modified expansion ring assembly 300', causing the seal 250 to seal the interface between sump cover 230 and the sump 210.

Steps may also include providing a sump 210 with a sump cover 230 having an observation portal 233, and observing the inside of the sump 210 through the observation portal 233, for instance to evaluate the condition of equipment inside the sump 210 and/or to evaluate the presence of liquid in the sump, and then taking action based on the observation.

The above description of the disclosed embodiments is provided to enable persons skilled in the art to make or use the invention. Various modifications to these embodiments will be readily apparent to those skilled in the art, and the generic principles defined herein can be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. A method of sealing the interface between: (1) a sump used in connection with an underground storage tank, the sump having an outer surface defining an exterior, an inner surface defining an interior, the outer surface defining an opening into the interior of the sump; and (2) a cover adapted to cover the opening, the method comprising:

providing a system comprising:

the sump and the cover;

an expanding ring assembly;

the cover adapted to be attached with the expanding ring assembly by fasteners, the cover further adapted to be urged toward the interface between the opening and the cover and the fasteners are adapted to urge the cover toward the expanding ring; and at least one seal adapted to seal the interface between the opening and the cover when the expanding ring assembly is affixed to the interior of the sump and the cover is attached with the expanding ring assembly and urged toward the interface between the opening and the cover by the fasteners;

affixing the expanding ring assembly to the interior of the sump by expanding the expanding ring assembly against the inner surface of the sump;

placing the cover proximate the opening and the seal proximate the cover and the opening: and attaching the cover to the expansion ring assembly with the fasteners, thereby urging the cover toward the interface between the opening and the cover and causing the seal to seal the interface between the opening and the cover;

whereby the expanding ring assembly is adapted to affix to the interior of the sump by expanding radially outward against the interior of the sump, the expanding ring assembly further adapted to be attached with the cover by the fasteners that urge the cover toward the expanding ring.

2. The method of claim 1, wherein the expanding ring assembly further comprises a rotatable threaded member attached therewith and the step of affixing the expanding ring assembly to the interior of the sump is accomplished by expanding the expansion ring assembly against the inner surface of the sump by rotating the threaded member.

3. The method of claim 1, further comprising the step of affixing a contracting band assembly to the exterior of the sump opposite the expanding ring assembly.

4. The method of claim 3, wherein the step of affixing the contracting band assembly to the exterior of the sump opposite the expanding ring assembly is accomplished by contracting the contracting band assembly against the outer surface of the sump.

5. The method of claim 1, wherein the seal is a water-tight seal.

6. The method of claim 1, wherein the cover includes an observation portal that allows a user outside the sump to see through the observation portal into the interior of the sump when the cover is covering the opening.

7. The method of claim 1, wherein the cover includes an observation portal that allows a user outside the sump to see through the observation portal into the interior of the sump when the cover is covering the opening, further comprising the step of:

looking through the observation portal into the interior of the sump when the cover is covering the opening.

8. The method of claim 1, further comprising the step of machining a surface of the sump that will come in contact with the seal.

9. A system for sealing the interface between: (1) a sump used in connection with an underground storage tank, the sump having an outer surface defining an exterior, an inner surface defining an interior, the outer surface defining an opening into the interior of the sump; and (2) a cover adapted to cover the opening, the system comprising:

an expanding ring assembly;

the cover adapted to be attached with the expanding ring assembly by fasteners, the cover further adapted to be urged toward the interface between the opening and the cover by the fasteners; and at least one seal adapted to seal the interface between the opening and the cover when the expanding ring assembly is affixed to the interior of the sump and the cover is attached with the expanding ring assembly and urged toward the interface between the opening and the cover by the fasteners, whereby the expanding ring assembly is adapted to affix to the interior of the sump by expanding radially outward against the interior of the sump, the expanding ring assembly further adapted to be attached with the cover by the fasteners that urge the cover toward the expanding ring.

10. The system of claim 1, wherein the expanding ring assembly further comprises a rotatable threaded member attached therewith and the expanding ring assembly is adapted to affix to the interior of the sump by expanding against the inner surface of the sump when the threaded member is rotated.

11. The system of claim 1, further comprising a contracting band assembly adapted to affix to the exterior of the sump opposite the expanding ring assembly.

12. The system of claim 1, further comprising a contracting band assembly adapted to affix to the exterior of the sump opposite the expanding ring assembly by contracting against the outer surface of the sump.

13. The system of claim 1, wherein the seal is a water-tight seal.

14. The system of claim 1, wherein the cover includes an observation portal that allows a user outside the sump to see through the observation portal into the interior of the sump when the cover is covering the opening.

15. A sump system for use in connection with an underground storage tank, the sump system comprising:

a sump having an outer surface defining an exterior, an inner surface defining an interior, the outer surface defining an opening into the interior of the sump;

a cover covering the opening such that there is an interface between the opening and the cover;

an expanding ring assembly affixed to the interior of the sump by compressive force directed by the expanding ring assembly radially outward against the interior of the sump, the expansion ring assembly attached with the cover by fasteners urging the cover toward interface; and at least one seal sealing the interface between the opening and the cover.

16. The system of claim 15, wherein the expanding ring assembly further comprises a rotatable threaded member attached therewith and the expanding ring assembly is expanded against the inner surface of the sump when the threaded member is rotated.

17. The system of claim 15, further comprising a contracting band assembly affixed to the exterior of the sump opposite the expanding ring assembly.

18. The system of claim 15, further comprising a contracting band assembly contracted against the outer surface of the sump opposite the expanding ring assembly.

19. The system of claim 15, wherein the seal is a water-tight seal.

20. The system of claim 15, wherein the cover includes an observation portal that allows a user outside the sump to see through the observation portal into the interior of the sump when the cover is covering the opening.

* * * * *